United States Patent [19]

Steelmon

[11] Patent Number: 4,980,564

[45] Date of Patent: Dec. 25, 1990

[54] RADIATION BARRIER FABRIC

[75] Inventor: George B. Steelmon, York, S.C.

[73] Assignee: Southern Manufacture, Inc., N.C.

[21] Appl. No.: 457,330

[22] Filed: Dec. 27, 1989

[51] Int. Cl.[5] ..... G21F 1/00

[52] U.S. Cl. ..... 250/505.1; 250/515.1; 250/519.1; 174/35 MS; 428/229; 428/242; 428/251; 428/263

[58] Field of Search ..... 250/505.1, 506.1, 502.1, 250/515.1, 516.1, 517.1, 518.1, 519.1; 174/35 MS; 342/1, 4; 428/229, 242, 251, 263

[56] References Cited

U.S. PATENT DOCUMENTS

| | | | |
|---|---|---|---|
| 1,892,424 | 12/1932 | De Geromini | 428/242 |
| 3,231,451 | 1/1966 | Gazelle | 250/517.1 |
| 3,239,669 | 3/1966 | Weinberger | 250/519.1 |
| 3,473,992 | 10/1969 | Martello et al. | 428/251 |
| 4,145,852 | 3/1979 | Hahn | 428/242 |
| 4,621,012 | 11/1986 | Pusch | 428/242 |
| 4,637,947 | 1/1987 | Maekawa et al. | 250/519.1 |
| 4,863,789 | 9/1989 | Arai | 174/35 MS |
| 4,913,978 | 4/1990 | Klotz et al. | 250/516.1 |

*Primary Examiner*—Jack I. Berman
*Assistant Examiner*—Kiet T. Nguyen
*Attorney, Agent, or Firm*—Juettner Pyle Lloyd & Verbeck

[57] ABSTRACT

A composite for blocking electromagnetic radiation includes a central layer of wire reinforced glass fabric, an outer exposure coating of materials which absorb the radiation, and an inner layer of metal.

8 Claims, 1 Drawing Sheet

RADIATION BARRIER FABRIC

BACKGROUND OF THE INVENTION

Lasers provide our intense source of electromagnetic radiation which may be focused into small diameter beams for a variety of practical uses. One application, for example, is in the use of high power lasers in materials processing such as cutting, drilling, welding, inscribing, and the like, in which the radiation is absorbed to produce intense heat in a precise, localized fashion. Lasers are also used in medical applications, communication, and a variety of research and other industrial applications.

The radiation produced by lasers, including direct, reflected and diffused beams, constitute a hazard to users and to workers in the vicinity. Accidental and chronic eye and skin exposure may result from direct and scattered radiation, as well as broadband radiation generated by the laser plume. The direct incidence of a high intensity laser may result in intense heat.

Particularly where high intensity laser beams are employed, such as with industrial metal welding or cutting operations, the use of shields or barriers are essential. Transparent filters in the form of curtains may be employed but are not effective against direct radiation. Other available shields include bulky curtains made up from a number of fabric layers, but these materials or laminates have a relatively low threshold against burning and penetration and are inconvenient to use.

SUMMARY OF THE INVENTION

An object of this invention is to provide a thin, flexible fabric-based shield which is effective against intense electromagnetic radiation. Another object of this invention is to provide a radiation protective fabric that will absorb and dissipate or attenuate electromagnetic radiation in a highly efficient and effective manner.

The foregoing objectives are accomplished by the provision of a composite fabric of heat resistant fibers having a metallic wire insert therein. The exposure side of the fabric is coated or impregnated with one or more elements or compounds which are substantially or preferably absorbent relative to the particular wavelength or wavelength of radiation being employed. The other or inner side of the fabric is provided with a metallic layer or coating to reflect any non-absorbed light back into the fabric and to act as an additional heat sink. To assure maximum protection from both sides, two of the composite fabrics are laminated together with the metal layers facing each other. The composite fabrics may be conveniently prepared using conventional aqueous-base coating methods.

The coated or impregnated fabric provides a media which is highly absorptive to laser beams. The metallic wire insert and the inner metallic layer together provide conductive paths to dissipate the absorbed radiation or heat away from the area of impingement. Also, the inner metallic layer serves to reflect any unabsorbed light back into the composite fabric.

The laser barrier fabric of the present invention is capable of continuously shielding against radiation at intensities up to 10 watts per square centimeter without any evidence of degradation, and to levels in excess of 60 watts per square centimeter without permanent damage. Because of the extremely high absorption and dissipation efficiency, the two-ply laminate is thin, relative to other available materials, and is easy and convenient to handle and use.

THE DRAWING

FIG. 1 is an exploded edge view of the radiation barrier fabric of the present invention, with a portion being partially delaminated to reveal the inner structure.

DESCRIPTION OF THE PREFERRED EMBODIMENTS

Figure 1:
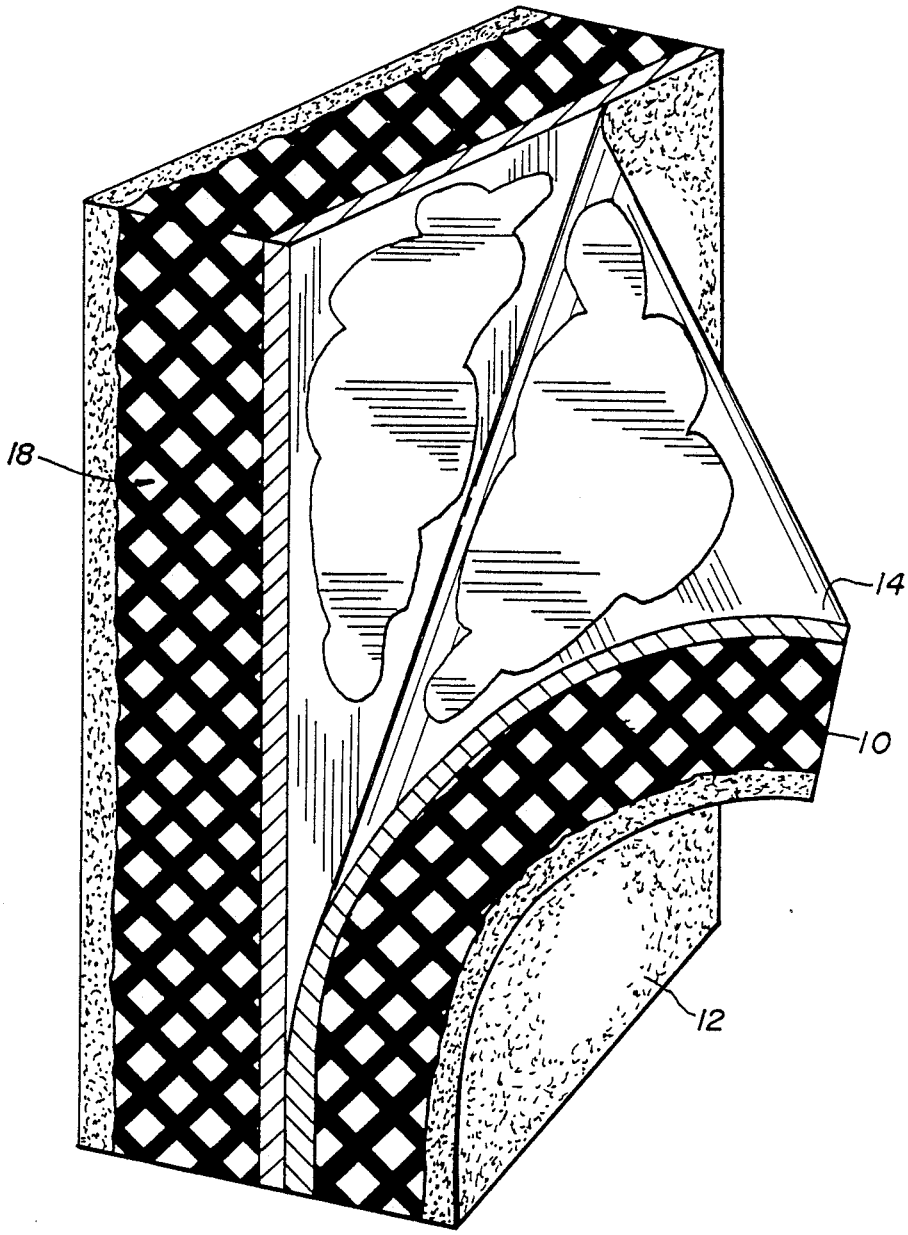

As shown in FIG. 1, the barrier fabric of the present invention comprises at least one layer of closely woven or knit heat resistant fabric 10. The basic material of the fabric 10 is preferably composed of glass fibers or yarns, or other heat resistant materials such as ceramic or asbestos. The fabric also has metallic wire incorporated therein. Various known methods may be employed to incorporate the wire into the fabric. The preferred method is to wrap the glass fibers around the wire using a conventional twisting process to produce a wire inserted yarn, followed by weaving or knitting the yarn into a cloth or fabric. The type of wire employed is not critical. Various ferrous based alloys may be employed, such as inconel or stainless, as well as others, such as copper, brass, aluminum and the like. The amount of wire employed in the fabric by weight will generally range in the order of from about two to about fifty percent. The fabric may be provided in a variety of weights, i.e., in the order of from about 0.5 to about 20 pounds per square yard.

For the purpose of the present invention, the wire inserted fabric is especially sturdy and may be repeatedly flexed without damage. Also, the fibers have a high tolerance for heat up to the melting point of the fiber, and the heat resistance per unit area is greatly increased by the inclusion of the metallic wire structure, which serves to conduct heat to surrounding cool regions. The wire also serves to maintain the integrity or framework of the fabric at higher temperatures.

The outer or exposure side of the glass-wire fabric is provided with a coating 12 which is highly absorbent to particular forms or ranges of radiation wavelengths of radiation being employed The coating preferably comprises elements or compounds which are opaque to the radiation and are stable or do not decompose at higher temperatures. If the fabric is used as a laser shield, powdered metals, metallic oxides and other metallic compounds may be employed. It is known that certain classes of materials are highly absorbent of radiation of various types, and the materials in the outer coating are selected to absorb the wavelengths to be encountered.

The absorptive materials, in powdered or flake form, are permanently applied as a coating by incorporating the solid materials as a suspension into an uncured organic polymeric matrix, in liquid form, followed by application of the coating in a uniform manner and subsequent curing, such as by heating in an oven. The polymers employed are preferably water based materials, such as acrylic, to avoid release of organic solvents into the atmosphere during application. It is apparent, however, that many types of organic or inorganic binders or other polymers are known and available and may be employed.

As indicated above the radiation absorptive materials employed in the outer coating may be selected to correspond to the wavelength of radiation to be encountered. Known types of lasers include argon, ruby, neon-nitrogen, helium-neon, galium arsenide, neodymiumyag, and carbon dioxide, each of which operate in a limited wavelength ranging from about 0.25 to 10.6 microns. Carbon dioxide lasers, commonly used in high temperature applications such as welding operate at a wavelength in the order of about 5.00 to about 10.6 microns. At such wavelength, certain metals and their oxides, carbonates, sulfates and other compounds, including copper, iron, manganese, barium and lead, are employed to provide a high absorption coefficient over the relevant spectrum.

If necessary or desired, a compound or group of elements compounds may be selected to be highly absorptive for a particular type of laser or a particular range of wavelengths. The elements or compounds may be selected by reference to available publications, such as *Handbook of Optical Constants of Solids*, Palik, Edward D., Academic Press., Inc. (1985).

In addition to the radiation absorption materials incorporated into the outer coating, the coating composition may contain fillers and metals in powder or flake form in order to improve heat conductivity and to reduce reflectivity of the surface. For example, aluminum flake or other metallic powder or flakes may be included in the coating composition. The use of aluminum flake also provides a grey finish which will reveal spots of incidence of stray laser beams, due to decomposition of the polymer binder. Visual detection is desirable in the event that corrective measures need to be taken with the laser system.

In general, sufficient solids are applied to the fabric to fill the majority of the pores therein and to completely cover the fabric. The amount of solids per unit weight of the fabric will be in the order of from about 10 to about 30%.

The inner side of the fabric 10 is provided with a coating or lay 14 of metal such as aluminum. While a metal foil may be laminated onto the fabric, a preferred method is to apply a coating of the metal by vapor deposition, applied under electrostatic vacuum conditions. Other metals may be employed, such as tin, zinc, lead, iron and the like. The inner metal layer, being in intimate contact with the fabric serves to reflect heat and radiation back into the fabric substrate and also serves to conduct heat away from the affected area. The thickness of the metal coating may be in the order of 1 to 10 mils.

The composite fabric as described above may be employed as a single sheet as described but is preferably laminated with the use of a suitable adhesive such as a latex to a second sheet 18, with the metal layers facing each other. The resulting laminate provides protection from either side and also provides an extra element of security. Under ordinary circumstances, however, even a concentrated laser beam at high power is not expected to penetrate beyond the inner metal layer.

A particular advantage of the radiation barrier fabric of the present invention is the ability to absorb direct and concentrated radiation without permanent damage. Moreover, the particular construction allows for a relatively thin and flexible fabric compared to other fabrics, e.g., a thickness of less than 0.5 inches and preferably less than 0.3 inches.

In further illustration of the present invention, the following examples are illustrative.

EXAMPLE I

A composite fabric for protection against $CO_2$ laser radiation was prepared. A wire inserted glass cloth broken weave construction, and containing 27% nickel alloy wire of a 0.006 inch diameter, was employed. A coating composition containing 100 lbs. 14B3005 acrylic emulsion (56% solids), 7.5 lb. aluminum flake, 10 lb. copper oxide, 10 lb. iron-manganese oxide, and 1 lb. barium sulfate was prepared and was applied to one side of the fabric at a rate of 16% solids for the finished product. The coated fabric was dried in an oven to cure the polymer The other side of the fabric was coated with a layer of aluminum (0.25 mil) by vapor deposition under electrostatic vacuum conditions. A two ply composite of the coated fabric was prepared by laminating two sheets together with latex, with the aluminum layers facing each other. Total thickness of the resulting composite was approximately 0.0125 inches The composite was tested by exposure to a $CO_2$ laser beam with a Gaussian spatial distribution and cross section of approximately 0.33 $cm^{-2}$. Below an intensity of 10 $W/cm^2$, the fabric was not affected by the beam. At higher intensities, some smoke and a red glow in the fabric were visible, although the fabric remained essentially undamaged. Exposures of up to 60 $w/cm^2$ for short periods of time (less than two minutes) did not appear to permanently damage the fabric, and no radiation transmission could be observed through the fabric. Intense exposure caused slight browning of the fabric, which provides a visual indication of incidence.

EXAMPLE II

The following elements and their compounds, especially oxides, carbonates and sulfates, are known to selectively absorb radiation at the wavelengths indicated.

| Wavelength (microns) | Laser | Element |
|---|---|---|
| 0.60–0.68 | He Ne | Sb, k |
| 0.68–1.30 | Ruby | Na, k, Sb |
| 0.90–10.80 | Nd:Glass | Fe, Mn, Ba, Hg |
| 0.75–1.08 | Nd | Ag, Cgo |
| 5.00–10.60 | $Co_2$ | Ca, Fe, Ba, Pb, Sn |

I claim:

1. A radiation barrier material comprising a central layer comprising a composite fabric of heat resistant fibers and metal wire, an outer layer bonded to said fabric comprising solids which are substantially absorptive to said radiation, and an inner layer bonded to said central layer comprising a continuous metallic sheet, said wire and metallic sheet providing conductive paths for radiation absorbed by said material.

2. The radiation barrier material of claim 1 comprising a pair of said barrier fabrics bonded together with the inner layers of said fabric facing each other.

3. The radiation barrier material of claim 1 wherein the heat resistant fibers of said composite fabric are wrapped around said metal wire in the form of a wire inserted yarn.

4. The radiation barrier material of claim 1 wherein said solids are disposed in said outer layer in a polymeric matrix.

5. The radiation barrier material of claim 1 wherein said metallic sheet is aluminum.

6. The radiation barrier material of claim 1 wherein said solids comprise metal oxides, carbonates and sulfates.

7. The radiation barrier material of claim 1 wherein said solids comprise metal flakes.

8. The radiation barrier material of claim 1 wherein said heat resistant fibers comprise glass fibers.

* * * * *